United States Patent [19]

Behrman

[11] Patent Number: 4,935,973

[45] Date of Patent: Jun. 26, 1990

[54] INFANT CHANGING BOARD ASSEMBLY

[76] Inventor: Stacey R. Behrman, 59805 Highway 318, Maybell, Colo. 81640

[21] Appl. No.: 438,873

[22] Filed: Nov. 20, 1989

[51] Int. Cl.[5] ..... A47D 5/00

[52] U.S. Cl. ..... 5/2 R; 5/431

[58] Field of Search ..... 5/2 R, 93 R, 82 R, 186 B, 5/400, 401, 409, 417, 420, 431–433, 447, 440, 470; 297/162, 353, 359, 383

[56] References Cited

U.S. PATENT DOCUMENTS

| | | | |
|---|---|---|---|
| 3,078,478 | 2/1963 | Sheahan | 5/93 R |
| 3,269,621 | 8/1966 | Dishart | 5/462 X |
| 3,659,297 | 5/1972 | Schutz | 5/93 R X |
| 3,729,752 | 5/1973 | Huggins | 5/93 R |
| 4,123,809 | 11/1978 | Pugh | 5/420 X |
| 4,712,258 | 12/1987 | Eves | 5/431 X |

*Primary Examiner*—Michael F. Trettel
*Attorney, Agent, or Firm*—Joseph F. Long

[57] ABSTRACT

An infant changing board assembly sized to store in an unobtrusive upright position in an infant carrier and to be easily moved into a horizontal position to provide a flat changing surface without removing the baby from the infant carrier.

11 Claims, 3 Drawing Sheets

INFANT CHANGING BOARD ASSEMBLY

BACKGROUND OF THE INVENTION

There appears to be a continuing need for improved, easier and safer methods associated with child care. This invention pertains to an aid to changing a baby's diaper and is particularly useful when the baby is being transported in an infant carrier. There are a great many inventions in this general field. We have considered the following:

| Ser. No. | Date | Inventor |
|---|---|---|
| 3,004,793 | 10/17/1961 | B. J. Loomis |
| 4,712,258 | 12/15/1987 | Harold J. Eves et al |
| 4,788,726 | 12/6/1988 | John S. Rafalko |
| 3,794,379 | 2/26/1974 | Dillon C. Furey |
| 4,133,063 | 1/9/1979 | Debbie Jones-Steele |
| 4,510,634 | 4/16/1985 | B. J. Deidrich et al |

None of these fill the same need as the current invention wherein a changing board assembly, designed to be washable, fits a variety of infant carriers, is stored in the carrier in an upright position and may be pulled from the lower end to slide into a horizontal position to provide a flat surface to change the baby.

SUMMARY OF THE INVENTION

The invention is designed to provide a nearly horizontal surface in an infant carrier for changing a diaper of an infant. It is designed to fit in the infant carrier and be storable in the carrier by fitting against the back portion of the carrier interior and also to span an interior of the carrier when pulled into the horizontal position. In a preferred embodiment, a flat changing board is fitted into a washable cover with snap fasteners on the cover to allow fastening a decorative coverlet thereto. The washable cover has a top positioning strap and may have Velcro fasteners to fasten to the outer portion of the infant carrier. The bottom positioning strap is used to pull the board to the horizontal position and may have a hook and loop fastener sold under the trademark Velcro but this is usually not necessary. The coverlet has three openings to admit the three cross connecting straps normally used to hold an infant in the carrier. The cross connecting straps must be disconnected to pull the changing board into a horizontal position.

In other embodiments, the changing board is slipped into a pouch on the back of the coverlet so that after disconnecting the cross connecting holding straps the coverlet containing the flat changing board may be moved to have the changing board in a nearly horizontal position inside the carrier when desired.

In yet another embodiment the coverlet may be simply snapped to the changing board. In all embodiments the changing board itself is easily removed to allow laundering of the coverlet and the washable cover in the embodiments using a changing board cover.

DESCRIPTION OF PREFERRED EMBODIMENTS

Figure 1:
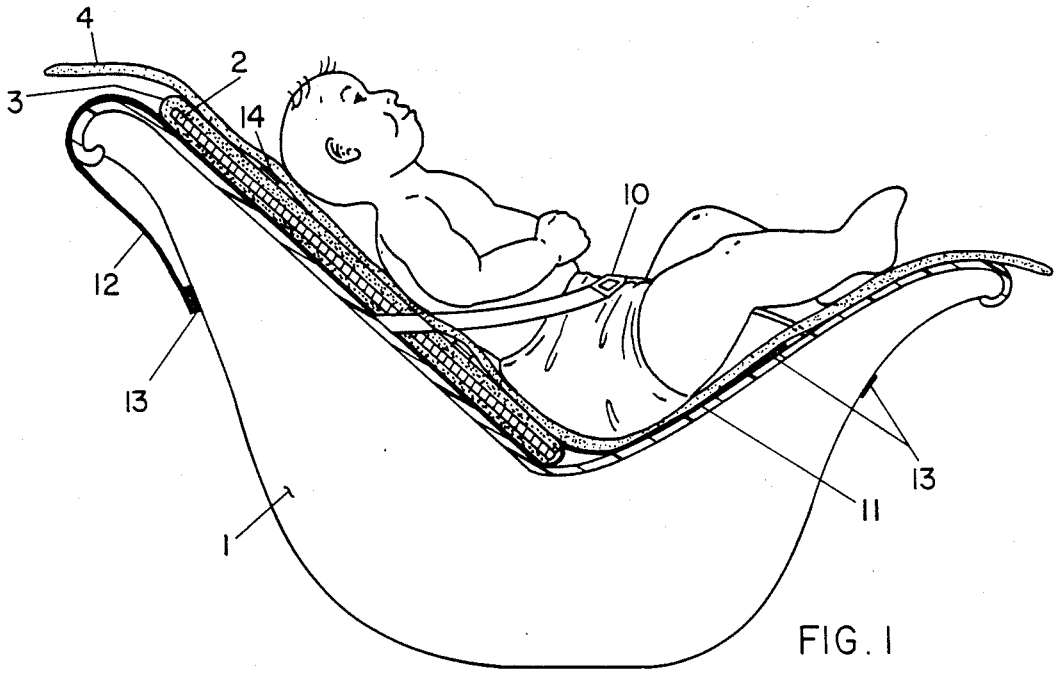
In FIG. 1 we depict an infant in a carrier 1, fastened in with cross-connecting straps that usually are adjustable. The changing board assembly is shown in a normal storage position behind the baby. Changing board 2 is covered with changing board cover 3 which has positioning straps 11 and 12 shown in FIG. 4. Coverlet 4 snaps to the changing board cover 3.
Figure 2:
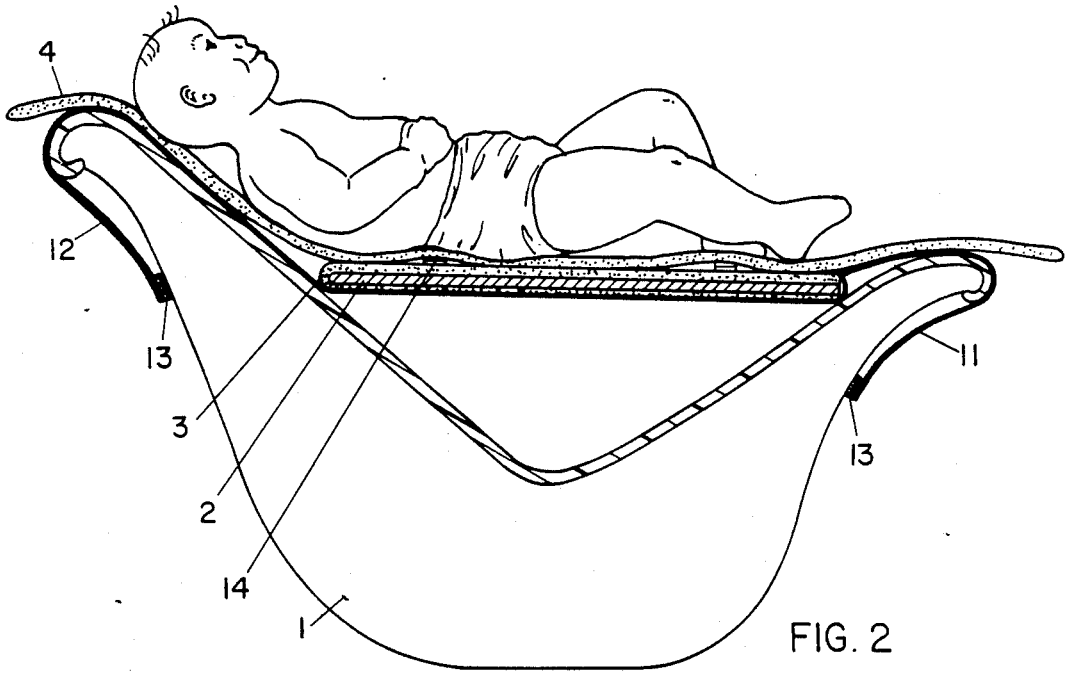
FIG. 2 shows the assembly horizontally, the position for changing the baby indicating snaps 14 and upper positioning strap 12 and lower positioning strap 11 that allows fastening the assembly firmly in place using interclasping fasteners such as Velcro 13.
Figure 3:
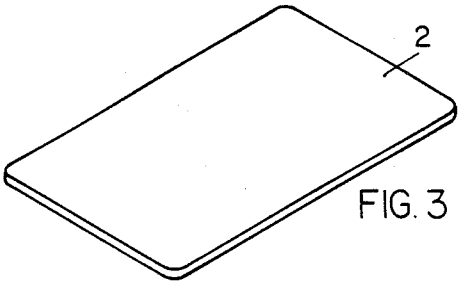
FIG. 3 shows the flat changing board 2. This may be made of plywood or semi-rigid or rigid plastic or of plastic with a waterproof spongy cushion material as an upper surface.
Figure 7:
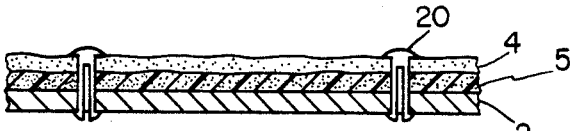
In FIG. 7 we have shown a third embodiment wherein button type fasteners 20 fasten the coverlet 4 directly to changing board 2, FIG. 3.
Figure 8:
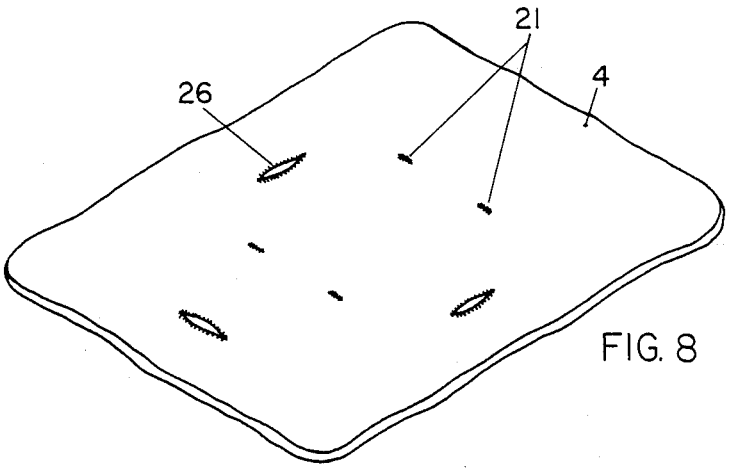
In FIG. 8 a top view of coverlet 4 is shown with button holes 21 to allow buttoning the coverlet to the changing board.
Figure 9:
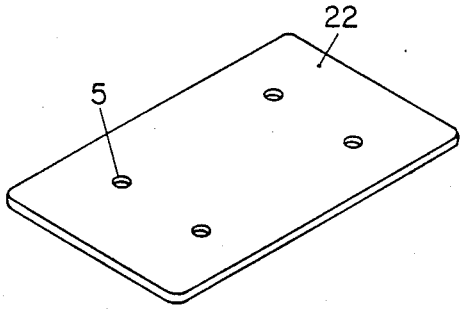
In FIG. 9 we show a second type changing board 22 with openings 5 to admit fasteners for buttons 20, shown in FIG. 7.

In a first preferred embodiment a flat rectangular changing board 2, FIG. 1, FIG. 2, and FIG. 3, may be made of a plywood sheet which may be sealed, varnished or even unfinished. A plastic such as polyethylene or polyprofylene would be equally suitable and plastic with foam padding 5, FIG. 7, integrally fastened to one side of a rigid plastic sheet would also be usable in all embodiments of the invention.

FIG. 1 depicts a baby in an infant carrier 1 showing the storage position of the changing board assembly comprising the changing board assembly with flat board 2, board cover 3 and coverlet 4 in a first embodiment. Also indicated are cross connecting straps 10 found in all infant carriers. The changing board assembly would be put in this position for use of the infant carrier.

In FIG. 2 we show the in-use position of the changing board assembly. This position is the same for all embodiments. In the first embodiment snaps 14 hold coverlet 4 to changing board cover 3 and positioning straps 11 and 12 attached to cover 3 are equipped with interclasping material such as Velcro which may be fastened to the exterior of carrier 1 to hold the assembly in place. In use, cross connecting straps 10, FIG. 1, are disconnected before pulling the assembly into a horizontal position with positioning strap 11.

FIG. 3 shows a top view of the flat rectangular changing board 2 which may be made of any of several materials including plywood and various different plastics.

Figure 4:
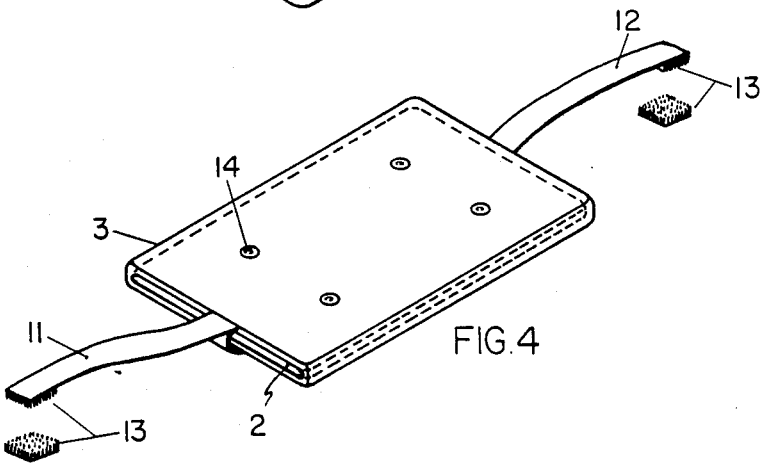
In FIG. 4 we show the removable cloth cover 3 to fit over the changing board 2, FIG. 1. The cloth cover has positioning straps 11 and 12 also made of cloth and sewn to the cover 3. Each of the positioning straps 11 and 12 may have a Velcro or interclasping fastener although the lower positioning strap usually will not have.

In the first embodiment a cover is used over the changing board. A bottom view of the cover showing snaps is shown in FIG. 4. The cover and coverlet 4 may be removed for washing and after washing changing board 2 may slide into cover 3. Cover 3 has connecting snaps 14, FIG. 3, to snap to the coverlet. Positioning straps to fasten the cover holding the board to the carrier are made of cloth and may have interclasping fasteners to fasten to the carrier. These are indicated on FIG. 4.

Figure 5:
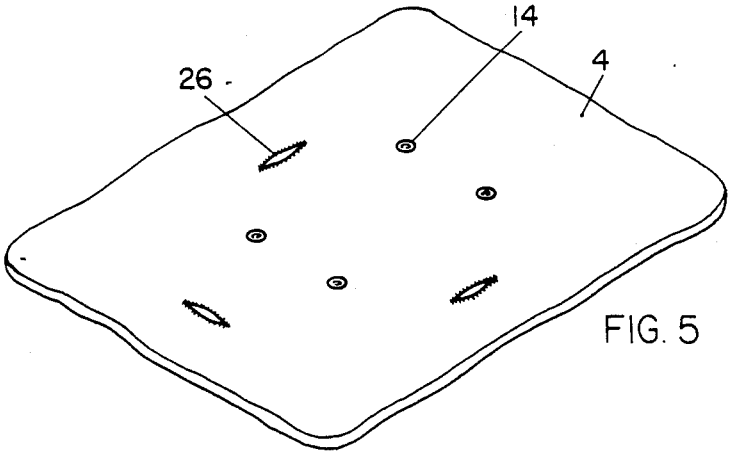
In FIG. 5 we show an underside of coverlet 4 with three openings 26 to admit cross connecting straps 10, FIG. 1, to hold a baby in the carrier. Snap fasteners 21 snap into matching halves of snap fasteners, FIG. 4.

A bottom view of the coverlet indicating snaps to snap to a board cover in a first embodiment is shown in FIG. 5.

Figure 6:
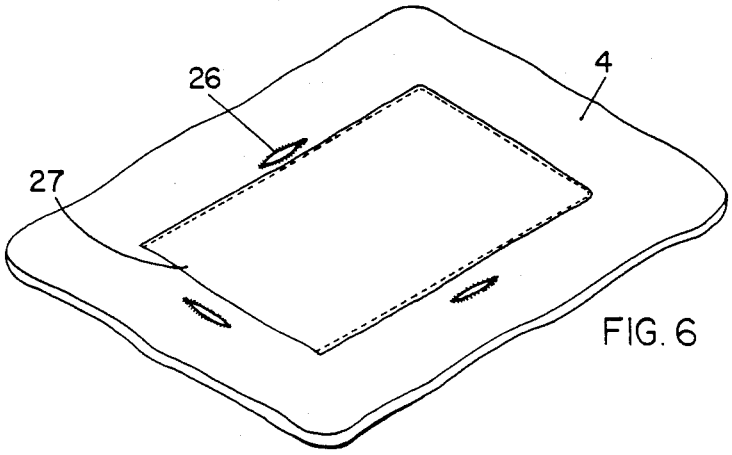
In FIG. 6 we show a second embodiment wherein coverlet 4 has a pouch 27 to hold the changing board 2, FIG. 3, openings 26 are for cross-connecting straps 10, FIG. 1.

In a second embodiment the coverlet is modified to have a pouch on the back of the coverlet so that the changing board simply slides into the pouch. The embodiment is indicated in FIG. 6 which shows an underside of a coverlet with pouch 27 sewn on the back. This embodiment would be slipped into an in-use position by simply pulling on the coverlet after disconnecting the cross connecting fastening straps.

In yet a third embodiment the coverlet is fastened to the changing board using a special type flat plastic button that may be pushed through openings in the coverlet and openings in the changing board to snap-fit into the changing board. Any of several means of fastening the flat button to the changing board such as an open staple, spring loaded button, etc., in a manner that the coverlet could be buttoned thereto would also be useable.

We claim:

1. An infant changing board assembly comprising:

(a) a flat changing board means sized to fit into an interior of an infant carrier closely adjacent to a portion forming a back of said infant carrier;

(b) a removable cloth covering to fit over said flat changing board means with snap means to removably fasten said removable cloth covering to a coverlet, said coverlet having openings to admit cross connecting means for fastening a baby in said infant carrier;

(c) a first adjustable positioning means with one end fastened to an upper end of said removable cloth covering and another end equipped with two segments of interclasping material with one segment of said interclasping material integrally fastened to said first adjustable positioning means and with a second segment of said interclasping material being equipped to fasten to said portion forming a back of said infant carrier;

(d) a second adjustable positioning means fastened to a lower end of said removable cloth covering to allow pulling said flat changing board means into a horizontal position in said infant carrier after disconnecting said cross connecting means to fasten a baby in said carrier.

2. An infant changing board assembly as in claim 1 where said second adjustable positioning means is equipped with interclasping material to allow fastening one end to said infant carrier to hold said flat changing board means in a horizontal position.

3. An infant changing board assembly as in claim 1 where in a flat changing board means is made of plywood.

4. An infant changing board assembly as in claim 1 wherein said flat changing board means is made of plastic.

5. An infant changing board assembly as in claim 1 wherein said flat changing board means is made with a rigid plastic back and an upper layer a minimum of ⅛" thick of a spongy plastic with a waterproof surface.

6. An infant changing board assembly comprising:

(a) a rectangular flat changing board means sized to slide into an infant carrier to be storable against a back of said infant carrier and to span an interior of said infant carrier when in a horizontal position;

(b) a coverlet with a pouch on an underside of said coverlet to contain said rectangular flat changing board means and with three openings located to admit cross connecting means to hold a baby in said infant carrier; when said flat rectangular changing board means is placed inside said pouch-like opening, said coverlet may be positioned so that said rectangular flat changing board means fits against a back of said carrier.

7. An infant changing board assembly as in claim 6 wherein said flat changing board means is made of plastic.

8. An infant changing board assembly as in claim 6 wherein said flat changing board means is made of plywood.

9. An infant changing board assembly as in claim 6 wherein said flat changing board means is made of a spongy plastic on a rigid back, said spongy plastic being non-absorbent.

10. An infant changing board assembly for use with an infant carrier comprising:

(a) a flat changing board means sized to slide into said infant carrier to be storable against a back of said infant carrier and to span an interior of said infant carrier when in a horizontal position;

(b) a coverlet having openings to admit cross connecting means of said carrier to hold a baby in said infant carier and having removable connecting means to fasten said coverlet to said flat changing board means.

11. An infant changing board assembly as in claim 10 wherein said removable connecting means is chosen from a group comprising interclasping plastic segments, metallic ring type snaps, plastic ring type snaps and buttons.

* * * * *